US008226329B2

(12) United States Patent
Richter et al.

(10) Patent No.: US 8,226,329 B2
(45) Date of Patent: Jul. 24, 2012

(54) DEVICE FOR PRODUCING VIBRATIONS

(75) Inventors: Uwe Richter, Alsfeld-Eudorf (DE); Johannes Koecher, Kuenzell (DE)

(73) Assignee: Thyssenkrupp GFT Tiefbautechnik GmbH, Alsfeld (DE)

( * ) Notice: Subject to any disclaimer, the term of this patent is extended or adjusted under 35 U.S.C. 154(b) by 192 days.

(21) Appl. No.: 12/672,559

(22) PCT Filed: Aug. 26, 2008

(86) PCT No.: PCT/DE2008/001416

§ 371 (c)(1),
(2), (4) Date: Apr. 28, 2010

(87) PCT Pub. No.: WO2009/049576

PCT Pub. Date: Apr. 23, 2009

(65) Prior Publication Data

US 2011/0013990 A1 Jan. 20, 2011

(30) Foreign Application Priority Data

Oct. 16, 2007 (DE) ..... 10 2007 049 435

(51) Int. Cl.
*E02D 11/00* (2006.01)
*E02D 7/18* (2006.01)

(52) U.S. Cl. ..... 405/232; 173/49

(58) Field of Classification Search ..... 405/232; 173/49; 74/61, 87

See application file for complete search history.

(56) References Cited

U.S. PATENT DOCUMENTS

| | | | | |
|---|---|---|---|---|
| 2,127,317 | A | 8/1938 | Welch | 74/61 |
| 2,778,230 | A | 1/1957 | Peterson | 74/61 |
| 2,831,353 | A | 4/1958 | Ongaro | 74/61 |
| 3,195,659 | A | 7/1965 | Goodman | 175/55 |
| 3,750,228 | A * | 8/1973 | Wake | 15/256.53 |
| 3,822,604 | A * | 7/1974 | Grimmer | 74/87 |
| 3,868,859 | A | 3/1975 | Scerbo | 74/61 |
| 4,306,300 | A | 12/1981 | Terman et al. | 365/45 |
| 4,856,358 | A * | 8/1989 | Montalbano | 74/84 R |
| 5,355,964 | A * | 10/1994 | White | 173/1 |
| 2002/0195378 | A1 * | 12/2002 | Cohen et al. | 209/366.5 |
| 2006/0214041 | A1 * | 9/2006 | Yao et al. | 241/175 |

FOREIGN PATENT DOCUMENTS

| | | |
|---|---|---|
| DE | 4139798 | 6/1993 |
| DE | 19631991 | 3/1998 |
| JP | 61233123 | 10/1986 |

* cited by examiner

*Primary Examiner* — John Kreck
*Assistant Examiner* — Kyle Armstrong
(74) *Attorney, Agent, or Firm* — Andrew Wilford

(57) ABSTRACT

The invention relates to a device for producing vibrations, particularly for fastening to ramming bodies, which are rammed into or pulled out of a burrow by said vibrations, comprising at least two balancing weights (15, 16) rotating in opposite directions in a synchronized manner and rolling on a track and driven by separate shafts. According to the invention, the track is a bearing ring (32) that is fitted into the housing, wherein said bearing ring is made of rolling bearing steel that has a hardness of HRC≧50.

13 Claims, 3 Drawing Sheets

DEVICE FOR PRODUCING VIBRATIONS

CROSS REFERENCE TO RELATED APPLICATIONS

This application is the US-national stage of PCT application PCT/DE2008/001416, filed 26 Aug. 2008, published 23 Apr. 2009 as WO2009/049576, and claiming the priority of German patent application 102007049435.3 itself filed 16 Oct. 2007, whose entire disclosures are herewith incorporated by reference.

FIELD OF THE INVENTION

The invention relates to a vibratory actuator, particularly for fastening to a pile that is to be driven into or pulled out of the ground, comprising at least two counterweights that rotate in opposite directions in a synchronized manner while rolling on respective tracks and being driven by respective shafts.

BACKGROUND OF THE INVENTION

As is generally known, elongated profiles, such as sheet piles, tubes or the like, are driven into or pulled out of the ground with the aid of vibration. To this end use is made of vibratory actuators, also called vibration rams or vibrating units. Such vibration rams or vibrating units may be fastened to a sheet pile or any other body to be driven in a nonpositive manner by a grab. Once the pile is vibrated, it can be driven into the ground or can be pulled out of it with little application of force, or even by its own weight. In many embodiments known from the prior art two eccentric masses are mounted on at least two separate shafts. The shafts are connected to each other via gears such that the counterweights rotate in opposite directions in pairs.

Jolting that could damage adjacent structure should be avoided when vibration-driving or extracting piles. The risk of damage is particularly high in the region of the resonance frequency of the ground.

In order to avoid damage the prior art provides vibrating units operating at a significantly higher frequency than the resonance frequency of the ground, so-called high-frequency vibration rams. It has been shown that the propagation of vibrations in the ground caused by the pile is reduced as frequency of the vibration ram increases.

Furthermore, starting and stopping the vibrating unit creates low-value resonance frequencies. The prior art has therefore often proposed that vibratory actuators be set up such that the vibration amplitude of the device is significantly reduced or equal to zero while passing through certain resonant frequencies.

For this purpose one embodiment according to the prior art provides a pair of counterbalance shafts whose off-center masses may be adjusted on a further shaft relative to each other via a controller, such as an actuating motor. In one phase position of the unbalanced masses relative to each other the centrifugal forces cancel each other. In another phase position that is offset by 180° the centrifugal forces of the unbalanced masses are additive in a plane.

The amplitude of the vibrating unit is determined by the so-called static torque, divided by the weight of the vibrating mass. The static torque is calculated from the masses of the rotating unbalanced masses, multiplied by the spacing of the center of gravity of the individual counterbalanced masses from the rotation axis. The results show that a high static torque and/or a small vibrating total mass are required for a high amplitude. As the characteristic variable of the vibration ram the amplitude is dependent upon the rotational speed, or the vibration frequency of the vibration ram.

High-frequency vibrating units require physically large bearings in order to be able to support the high centrifugal forces per shaft, thus increasing the dynamic weight of the vibrating mass and therefore reducing the amplitude. The adjusting devices also increase the dynamic weight of the vibration rams such that an additional reduction of the amplitude takes place. Increasing the static torque for larger and heavier driving equipment is technically possible only by increasing the number of counterbalance shafts, which is associated with a proportional increase of the physical size of the vibrating unit. Due to the associated weight increase there is no improvement in amplitude.

A particular embodiment of vibratory actuators corresponding to the prior art is the so-called vertical vibrating unit. It is an embodiment having a narrow width so that a third pile can be set between two piles that are not yet driven in. The narrow width is achieved in that the individual counterbalance shafts are placed vertically on top of each other. According to the prior art four shafts are on top of each other for this purpose is order to eliminate any torques caused by the horizontal force. In this specific configuration a reduction of amplitude up to a zero value is achieved in that two unbalanced masses can be rotated relative to each other on one shaft. The preferred arrangement of the adjusting mechanism according to the prior art is an adjuster on an axis between two pairs of shafts. Due to this arrangement a relatively tall structure in the vibrating unit is the result. Since these types of vibrating units are usually mounted on an extension in a displaceable manner via a carriage, the maximum length of the piles to be placed is reduced by their construction height. An arrangement of unbalanced masses and shafts is known from patent application DE 196 31 991, which reduces the number of shafts required to three in order to create a low construction height.

U.S. Pat. No. 2,831,353 provides, for example, a high-power vibrating unit having a housing with two spaced bores, with two is counterweights rolling on the walls of the bores. The counterweights are each mounted on an arm, and the angle formed by the arms and therefore between the counterweights can be adjusted by a mechanism such that different counterbalanced torques may be set. For this purpose, however, neither the complicated adjusting mechanism, nor the simple guidance of the rollers in groves are suitable to satisfy the object described above of realizing a compact vibrating unit of high power at a high vibrating frequency. The object of the present invention is to create a device of the above stated type, which achieves a significantly higher amplitude of high-frequency vibration rams at a decreased physical size than is possible according to prior art, and which enables an adjustability of the vibration amplitude in an expanded embodiment.

A device is also known from DE 41 39 798 in which two shafts extending at a spacing and parallel to each other are provided in the housing thereof. An individually adjustable hydro-motor driving the shafts is associated with each of the shafts. Each shaft carries a counterweight in the form of a piston that is displaceable longitudinally in each of the hollow bodies parallel to the longitudinal axis in a relatively free-moving manner. The hollow body is integral with the respective shaft. The longitudinal axes of the different hollow bodies on different shafts are parallel to each other and orthogonal to a center line on which the center points of the shafts are positioned at a spacing from each other. Counterweights are longitudinally adjustable in the hollow bodies. In order to prevent the momentary generation of resonance frequencies at a high amplitude of the is vibratory actuator, the shafts are accelerated in the idle mode up to the desired rotational speed with the counterweights in neutral position. The counterweights are displaced into eccentric positions only after achieving the desired rotational speed.

OBJECT OF THE INVENTION

The object of the present invention is to create a device of the type mentioned above in which a high amplitude may be achieved at a high frequency. Another object of the present invention is to significantly reduce the physical size of conventional vibrating units, particularly so-called vertical vibrating units. Another object of the present invention is to provide a simple adjusting mechanism for a vibration amplitude down to zero.

SUMMARY OF THE INVENTION

The device is characterized according to the invention in that in a preferred embodiment both the counterweights and the tracks are produced from a hardened material from a roller-bearing steel having a hardness of HRC≧50, and comprises suitable lubrication in the contact area of the roller pairs. In order to prevent sliding of the counterbalanced rollers when starting, a radially directed elastic bias is essential. Due to the combination of hardened rolling surfaces and lubrication, a substantially higher amplitude and vibration force may be achieved as compared to conventional high-frequency rotating vibrating units at the same frequency and significantly smaller physical size. Suitable materials for the raceways and rollers are thoroughly hardened steel and case-hardened steel. Lubrication is provided in order to keep wear as low as possible in the roller contact area. Preferably, oil lubrication is provided that may be realized as an immersion-bath lubrication system. In order to be able to ensure improved heat dissipation a pressure circulation lubrication device may also be provided.

In a first embodiment the bearing ring is removable and replaceable. This provides the advantage that in case of wear on the track it may simply be replaced.

The device according to the invention is characterized in a preferred embodiment in that one or more cylindrical counterweights roll on the inner walls of two stationary bearing cups at whose center axes they are connected to a drive shaft via an arm such that static torques increase significantly.

The particular advantage of the device is that the static torques that can be created may be significantly increased, if hardened steel is utilized as the material for the bearing cups and the counterweights. Furthermore, the centrifugal forces created during rotation may be absorbed without the otherwise common significant bending loads of the drive shaft.

In a first embodiment two counterweights are mounted in each bearing cup, which are connected to each other in a rigid manner such that their relative spacing is not changed. The weights act kinematically as one single weight that roll on a circular arc determined by the bearing cup.

As an alternative two counterweights are mounted in the bearing cup via arms in a pivoting and rotating manner according to a further embodiment, but the angular spacing of the arms may be changed. In such an arrangement it is therefore also possible to mount the rotating counterweights at an angular spacing of, for example, 180° such that—with the same off-center masses and the same radial spacings from the drive shaft—the off-center masses of the counterweights compensate each other out (provided that the centrifugal forces of the arms and of the remaining connection means are negligible). In an advantageous manner the angular spacing of the arms may be adjusted by an adjuster that can rotate with the respective drive shaft. After the adjustment has been carried out, no further friction losses occur due to the movement of the additional shafts.

A particularly compact physical structure is achieved in that two shafts rotating in opposite directions are on the same axis, so that the structural width of the vibrating unit is cut in half. In this manner a particularly compact configuration is achieved for the so-called vertical vibrating units. The reversal of rotation direction on an axis may be achieved via a right-angle drive, in this case a bevel gear, using simple means. A significant increase of the usable length of a ram-guided vibrating unit may be obtained by the configuration with a simultaneous performance increase of the vibrating unit.

The adjustable angular spacing of the arms is also preferably limited to a minimum value by a spacer formed according to a further embodiment of the invention by free legs of an L-shaped arm that abut each other at a minimum spacing. The spacer ensures that the rotating cylindrical or spherical counterweights may rotate freely in the bearing cup.

Preferably, the sum of the diameter of the counterweight plus the radius of the drive shaft equals the radius of the bearing cup in which the counterweights can rotate.

In order to prevent wear caused by foreign bodies getting into the track, the invention preferably provides a track protector in front of and/or behind the counterweights, preferably a doctor blade stripping foreign bodies from the counterweights. Wear both of the counterweights and of the bearing ring is thereby prevented, thus significantly improving the service life of the components.

An advantageous embodiment provides that the counterweights are pushed against the bearing ring, particularly at low speed, by a pressure spring at a minimum pressure. In this manner sliding of the counterweights on the bearing ring is prevented during starting of the device, e.g. at low speed. This also reduces to a minimum wear that is always created during sliding between two solid bodies.

The counterweights in the different bearing cups rotate in opposite directions in a synchronized manner. The synchronization may be realized—as generally in the known constructions according to prior art—via a gear drive, or for example by a belt drive.

BRIEF DESCRIPTION OF THE DRAWING

Further descriptions are provided with reference to the drawings. Therein.

DETAILED DESCRIPTION

Figure 1:
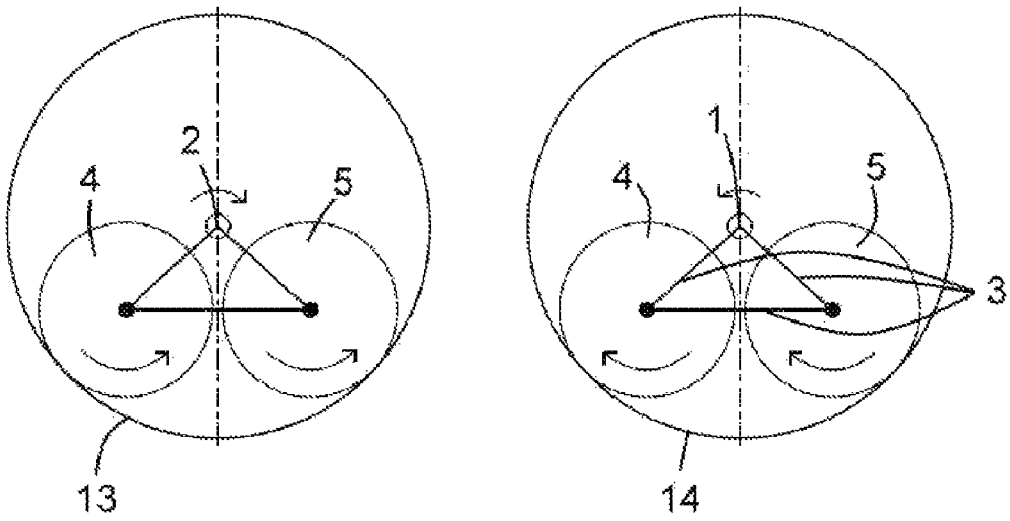
FIG. 1 is schematic diagrams of two bearing cups of a vibration device, each equipped with two counterweights in different angular positions.

FIG. 1 shows two bearing cups 13 and 14, each comprising a pair of cylindrical counterweights 4 and 5, the counterweights of one pair are coupled to each other in a rigid manner via links 3 such that each pair acts kinetically as a single constant counterweight and may roll in the bearing cup in the direction of the arrows. The drive is carried out via a shaft 1 or 2. According to the invention both the counterweights 4 and 5 and the tracks formed by the bearing cups are comprised of a hardened material, such as a roller-bearing steel that has a hardness of HRC≧50.

Figure 5:
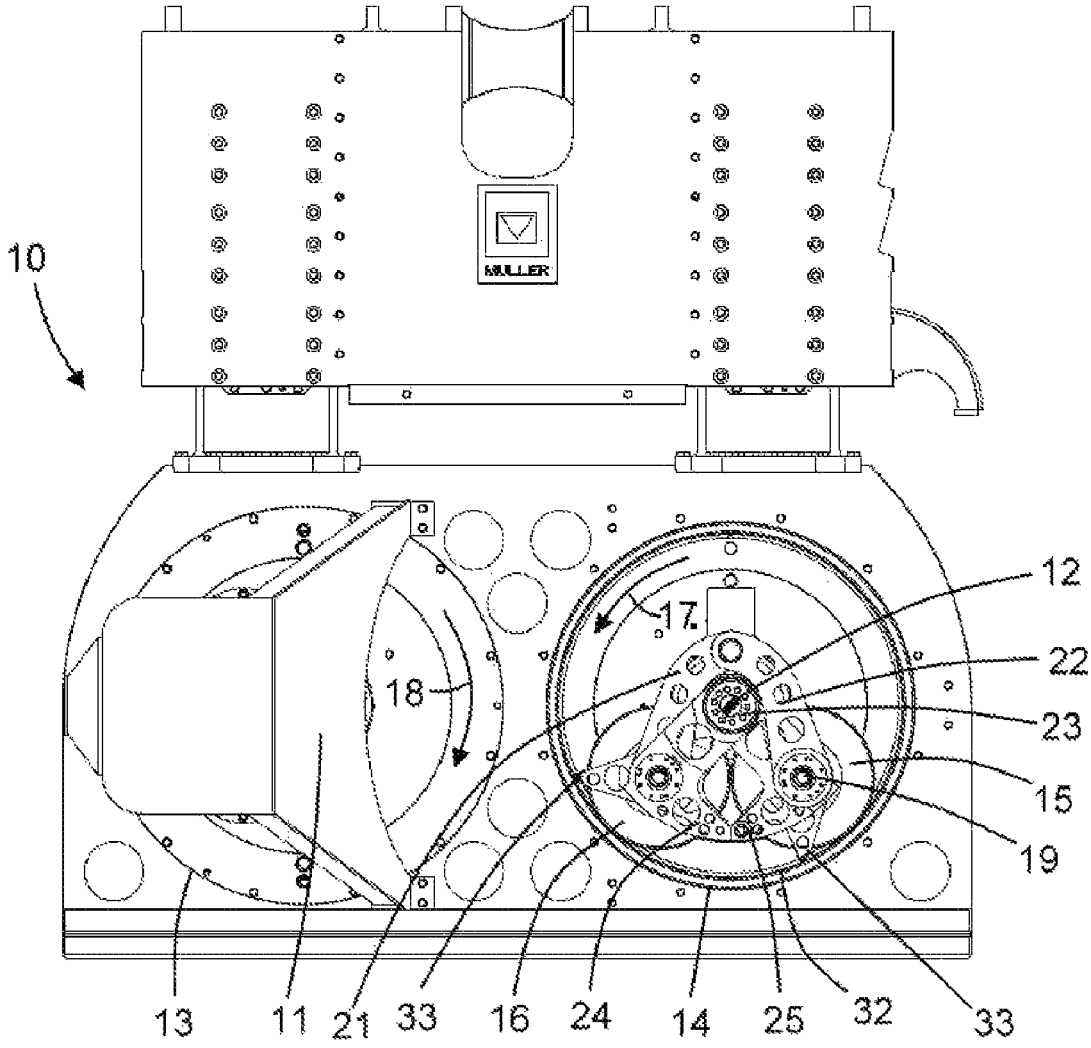
FIG. 5 shows a further embodiment according to the invention with a doctor blade.

The counterbalanced device 10 according to FIG. 5 has two bearing cups 13 and 14 that are centered on respective axes 11 or 12, into each of which a bearing ring 32 is incorporated. Two (or more) counterweights 15 and 16 shaped as cylinders can roll on the inner surfaces of the bearing rings 32. The bearing surfaces of the bearing rings 32 and/or of the counterweights 15 and 16 may be lubricated by a device, for this purpose preferably an oil immersion device 31. The respective rolling directions as shown by arrows 17 and 18 of the counterbalanced bodies in their hollow cups or shafts 13 and 14 are opposite. Two track-protecting doctor blades 33 are provided. In order to prevent the counterweights from sliding on the bearing rings 323 at low frequencies, a biasing device (not illustrated) is provided that pushes the counterweights 15 and 16 outward against the respective bearing rings 32. Synchronized movement of the counterweights in opposite directions is ensured, for example, by a gear drive, belt drive, or the like.

Each cylindrical counterweight 15 of 16 is carried on a respective axis 19 on a respective L-shaped arm 21 or 22. Each L-shaped arm in turn is fastened by one leg to a respective rotating shaft 23. Their other free legs 24 and 25 abut angularly to form a spacer in a position in which the two cylindrical counterweights 15 and 16 have a minimal angular spacing from one another. An electric, hydraulic or pneumatic controller (not illustrated) enables the variable adjustment of the angular spacing of the angular arms 21 and 22 up to 180°. In this 180° position the cylindrical counterweights 15 and 16 extend in the respective in the hollow shaft 13 or 14 diametrically opposite such that their static torques cancel each other out. In this position the vibratory actuator may be powered up to the desired operating frequency without vibration. The vibration amplitude may be varied in that the relative angles of the counterweights 15 and 16 are adjusted. In order to clear the track of dirt and debris a doctor blade 33 is mounted in front of or behind each of the counterweights 15 and 16 to strips dirt and dust particles from them.

Figure 4:
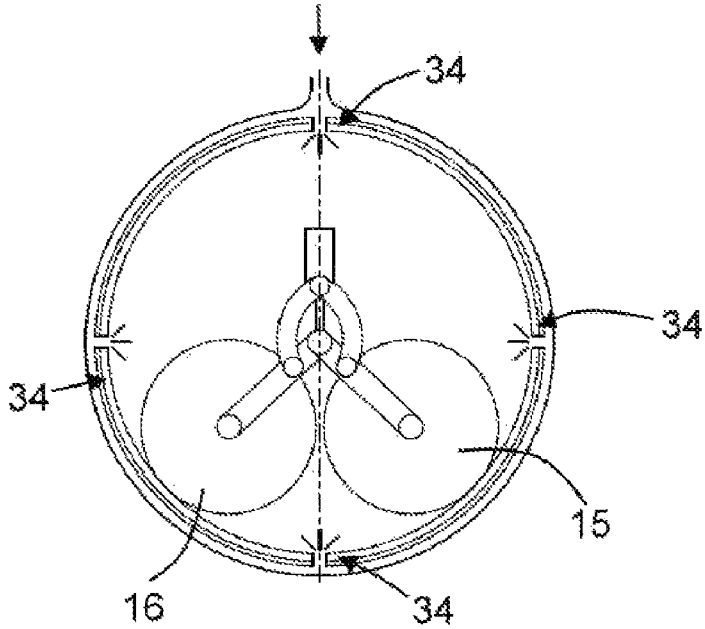
FIGS. 2, 3, and 4 are schematic diagrams of a preferred embodiment of the counterbalanced adjustment device and different lubricating devices.
Figure 2:
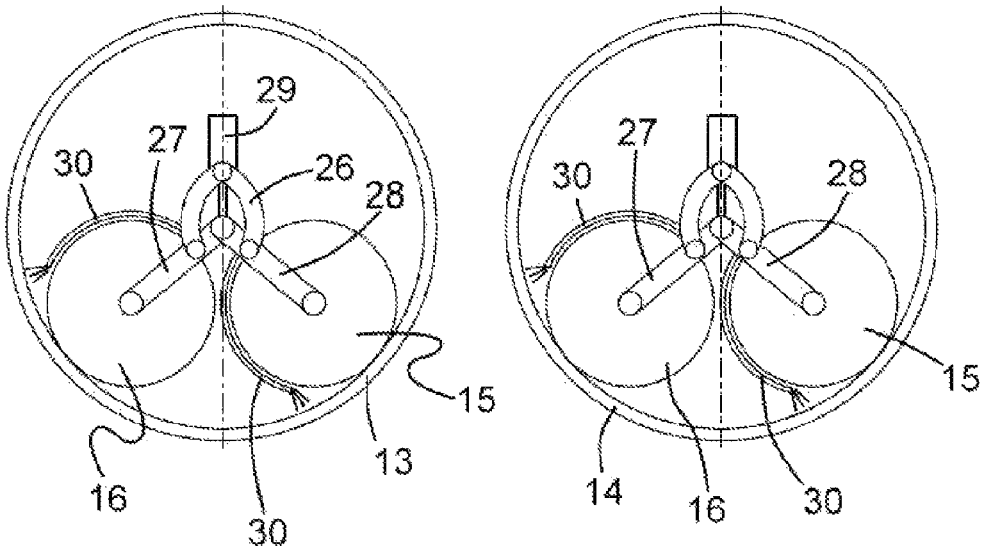
Figure 3:
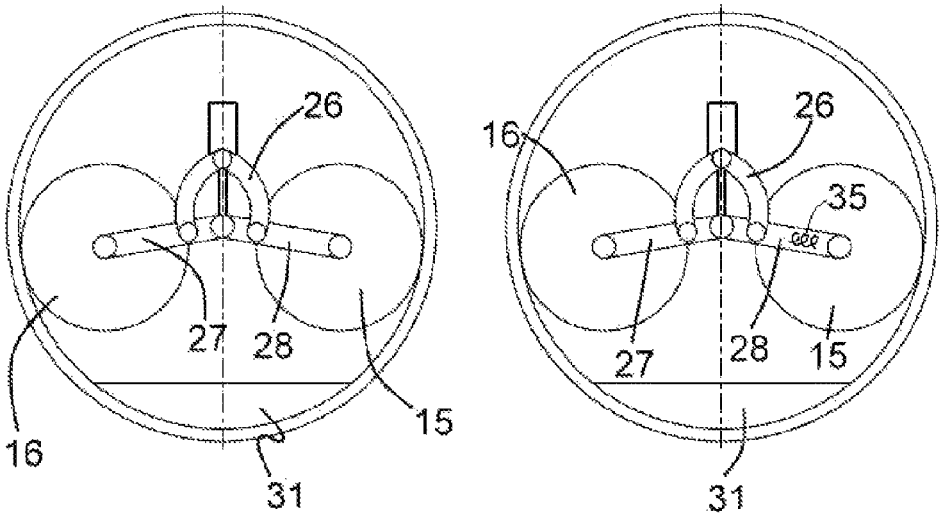

FIGS. 2 and 3 schematically show adjustment members 26 that engage the arms 27, 28. Any desired angular positions may be variably set by linear displacement of an actuator 29. In FIG. 2 a minimum angle of about 70° is set, and an angle of nearly 180° is set in FIG. 3, the counterweights 15, 16 and the parts connected to them and rotating along with the counterweights being at a static balance. Furthermore, FIG. 2 shows a lubricant sprayer 30, FIG. 3 shows an immersion bath 31, and FIG. 4 shows a pressure sprayer 34 as an alternative lubrication device. FIG. 3 also schematically illustrates a spring 35 capable of pushing the counterweight radially outward into engagement with the inside of the cup 14 forming the track on which this counterweight 15 rides at low speed to prevent slipping.

The invention claimed is:

1. A vibratory actuator for fastening to a pile being driven into or pulled out of the ground while being vibrated, the actuator comprising:

a circular track centered on an axis, a drive shaft extending along and rotatable about the axis, a pair of arms secured to and rotatable with the shaft and extending radially therefrom, respective counterweights rotating in opposite directions in a synchronized manner on outer ends of the arms and each rolling on the track, both the counterweights and the track being comprised of a hardened material having a hardness of HRC≧50, an actuator means carried on and rotatable with the shaft for pivoting the arms on the shaft about the axis and varying an angular spacing of the counterweights, and a lubrication device in a contact area of the two counterweights with the track.

2. The vibratory actuator according to claim 1, wherein the track is a replaceable bearing ring.

3. The vibratory actuator according to claim 1 wherein the lubricating device is an immersion bath or pressure-circulation lubrication device.

4. The vibratory actuator according to claim 1, wherein the counterweights are elastically biased against the track.

5. The vibratory actuator according to claim 1 wherein the adjustable angular spacing of the arms is limited to a minimum and maximum value by respective spacers.

6. The vibratory actuator according to claim 5, wherein the spacers are formed by free legs of L-shaped arms that abut each other at a minimum spacing.

7. The vibratory actuator according to claim 1 wherein the sum of the diameter of each of the counterweights and the radius of the respective drive shaft is equal to an inner radius of the track.

8. The vibratory actuator according to claim 1 further comprising a respective track protector mounted in front of or behind the counterweights.

9. The vibratory actuator according to claim 1, further comprising a spring that in the case of low frequencies pushes the counterweights against the bearing ring at a minimum pressure.

10. The vibratory actuator according to claim 8 wherein the track protector is a doctor blade.

11. The vibratory actuator according to claim 1 wherein the hardened material has a hardness of HRC≧55.

12. The vibratory actuator according to claim 1 wherein the material is a roller-bearing steel.

13. A vibratory actuator for fastening to a pile being driven into or pulled out of the ground while being vibrated, the actuator comprising:

a circular track centered on an axis, a drive shaft extending along and rotatable about the axis, a pair of L-shaped arms secured to and rotatable with the shaft and extending radially therefrom and having free ends directed angularly toward each other, respective counterweights rotating in opposite directions in a synchronized manner on outer ends of the arms and each rolling on the track, both the counterweights and the track being comprised of a hardened material having a hardness of HRC≧50, an actuator for pivoting the arms on the shaft about the axis and varying an angular spacing of the counterweights, the free ends being angularly engageable with each other in a position of minimal angular spacing of the arms with the counterweights out of engagement with each other; and a lubrication device in a contact area of the two counterweights with the track.

* * * * *